US010643535B2

(12) United States Patent
Yang et al.

(10) Patent No.: US 10,643,535 B2
(45) Date of Patent: May 5, 2020

(54) DRIVING METHOD FOR PREVENTING IMAGE STICKING OF DISPLAY PANEL UPON SHUTDOWN, AND DISPLAY DEVICE

(71) Applicant: BOE TECHNOLOGY GROUP CO., LTD., Beijing (CN)

(72) Inventors: Fei Yang, Beijing (CN); Song Meng, Beijing (CN); Hongjun Xie, Beijing (CN); Quanhu Li, Beijing (CN); Yue Wu, Beijing (CN); Yu Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/555,538

(22) Filed: Aug. 29, 2019

(65) Prior Publication Data

US 2020/0005711 A1 Jan. 2, 2020

Related U.S. Application Data

(63) Continuation of application No. 15/535,585, filed as application No. PCT/CN2016/109261 on Dec. 9, 2016, now Pat. No. 10,446,077.

(30) Foreign Application Priority Data

Apr. 15, 2016 (CN) ..... 2016 1 0236636

(51) Int. Cl.
*G09G 3/3233* (2016.01)

(52) U.S. Cl.
CPC ..... *G09G 3/3233* (2013.01)

(58) Field of Classification Search
CPC ..... G09G 3/3258; G09G 3/3233; G09G 2310/0251; G09G 2310/0254;
(Continued)

(56) References Cited

U.S. PATENT DOCUMENTS 9,047,823 B2 6/2015 Kim et al.
2008/0129903 A1 6/2008 Hong
(Continued)

FOREIGN PATENT DOCUMENTS

CN 101364390 A 2/2009
CN 103400546 A 11/2013
(Continued)

OTHER PUBLICATIONS

Search Report and Written Opinion dated Feb. 24, 2017 from State Intellectual Property Office of the P.R. China.
(Continued)

*Primary Examiner* — Christopher E Leiby
(74) *Attorney, Agent, or Firm* — Dilworth & Barrese, LLP.; Michael J. Musella, Esq.

(57) ABSTRACT

A driving method for preventing image sticking of a display panel (805) upon shutdown, and a display device (800). The method includes: receiving a shutdown signal (S01, S16); and adjusting driving signals of a sub-pixel circuit (708, 810) of the display panel (805), so as to reduce the voltage difference between a gate electrode and a source electrode of a driving transistor (T1) of the sub-pixel circuit, and hence allowing the display panel (805) to enter an image sticking prevention mode (S02, S17). The method can prevent image sticking of the display panel (805) at the time of shutdown and hence improve the display quality.

9 Claims, 6 Drawing Sheets

(58) Field of Classification Search
CPC ..... G09G 2310/067; G09G 2310/0262; G09G 2320/043; G09G 2320/048; G09G 2320/0257; G09G 2330/027; G09G 60/16; G09G 2300/0852; G09G 2300/0861
See application file for complete search history.

(56) References Cited

U.S. PATENT DOCUMENTS

| | | | | |
|---|---|---|---|---|
| 2008/0165099 | A1 | 7/2008 | Cho | |
| 2010/0182303 | A1 | 7/2010 | Takasugi et al. | |
| 2014/0092144 | A1 | 4/2014 | Kim et al. | |
| 2014/0168184 | A1* | 6/2014 | Kim ..... | G06G 3/3258 345/209 |
| 2015/0206477 | A1 | 7/2015 | Xu | |
| 2015/0379937 | A1 | 12/2015 | Kim et al. | |
| 2016/0275859 | A1 | 9/2016 | Tseng | |

FOREIGN PATENT DOCUMENTS

| | | | |
|---|---|---|---|
| CN | 103440840 | A | 12/2013 |
| CN | 203366703 | U | 12/2013 |
| CN | 103714776 | A | 4/2014 |
| CN | 103871359 | A | 6/2014 |
| CN | 103943064 | A | 7/2014 |
| CN | 104778925 | A | 7/2015 |
| CN | 105702207 | A | 6/2016 |
| CN | 106097973 | A | 11/2016 |
| JP | 2004093682 | A | 3/2004 |
| JP | 2016009185 | A | 1/2016 |
| KR | 1020140042614 | A | 4/2014 |
| KR | 20140081652 | A | 7/2014 |
| KR | 1020140082040 | A | 7/2014 |
| WO | 2015063981 | A1 | 5/2015 |
| WO | 2015063988 | A1 | 5/2015 |
| WO | 2015180341 | A1 | 12/2015 |

OTHER PUBLICATIONS

Chinese Office Action dated Sep. 4, 2017.
Korean Office Action dated Jun. 28, 2018.
Second Korean Office Action dated Dec. 26, 2018.
European Search Report dated Oct. 16, 2019.

* cited by examiner

DRIVING METHOD FOR PREVENTING IMAGE STICKING OF DISPLAY PANEL UPON SHUTDOWN, AND DISPLAY DEVICE

This application is a continuation of U.S. patent application Ser. No. 15/535,585 filed on Jun. 13, 2017, which is a U.S. National Phase Entry of International Application No. PCT/CN2016/109261 filed on Dec. 9, 2016, designating the United States of America and claiming priority to Chinese Patent Application No. 201610236636.5 filed on Apr. 15, 2016. The present application claims priority to and the benefit of the above-identified applications and the above-identified applications are incorporated by reference herein in their entirety.

TECHNICAL FIELD

Embodiments of the present disclosure relate to a driving method for preventing image sticking of a display panel upon shutdown, and a display device.

BACKGROUND

Organic light-emitting diode (OLED) display panels has wide development prospect in the display field due to the characteristics of autoluminescence, high contrast, low thickness, wide viewing angle, fast response speed, capability of being applied in flexible panels, wide usage temperature range, simple production process, etc.

Due to the above characteristics, the OLED display panel may be applicable to devices with display function such as a mobile phone, a display, a notebook computer, a digital camera and an instrument.

SUMMARY

An embodiment of the present disclosure provides a driving method for preventing image sticking of a display panel upon shutdown, which comprises: receiving a shutdown signal; and adjusting driving signals of a sub-pixel circuit of the display panel, so as to reduce the voltage difference between a gate electrode and a source electrode of a driving transistor of the sub-pixel circuit, and hence allowing the display panel to enter an image sticking prevention mode.

An embodiment of the present disclosure further provides a display device, which comprises: a display panel; a sub-pixel circuit being disposed on the display panel and including a driving transistor and a storage capacitor connected between a gate electrode and a source electrode of the driving transistor; and a drive apparatus configured to: adjust driving signals of the sub-pixel circuit of the display panel, so as to reduce a voltage difference between the gate electrode and the source electrode of the driving transistor of the sub-pixel circuit, and hence allow the display panel to enter the image sticking prevention mode.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
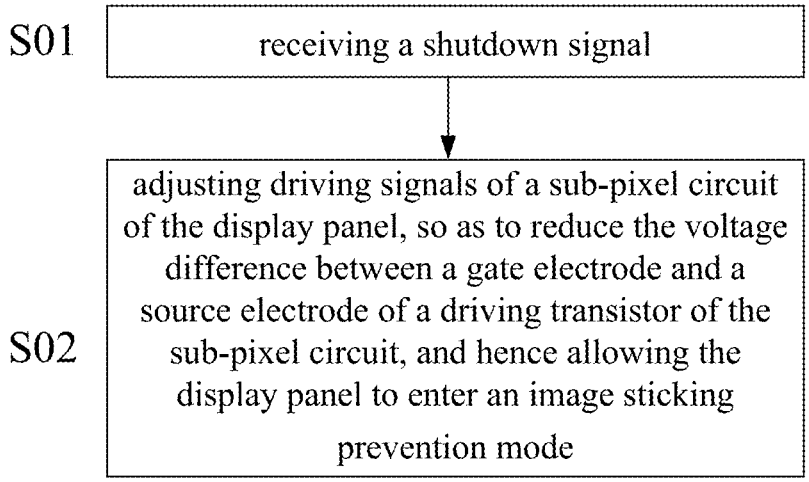
FIG. 1 is a flow diagram 1 of a driving method for preventing image sticking of a display panel at the time of shutdown.

The technical solutions of the embodiments will be described in a clearly and fully understandable way in connection with the drawings related to the embodiments of the invention. With the reference to the non-limitative embodiments as shown in the drawings and described as follows, embodiments of the present disclosure and their various features and favorable details are described more fully. It should be noted that the features shown in the drawings are not necessarily drawn to scale. The present disclosure omits the description of known materials, components and processes so as to not obscure the embodiments of the present disclosure. The embodiments are intended only to facilitate the understanding of the practice of the embodiments of the present disclosure, and to further enable those skilled in the art to practice the embodiments. Therefore, the examples should not be limitative of the embodiments of the present disclosure.

Unless otherwise defined, the technical or scientific terms used in the present application should be the general meaning understood by those having ordinal skills in the art. The terms "first", "second" and similar words used in the specification and claims of the patent application of the present disclosure do not represent any order, quantity or importance, and are merely intended to differentiate different constituting parts. In addition, in embodiments of the present disclosure, the same or similar reference numerals represent the same or similar elements.

An embodiment of the present disclosure provides a driving method for preventing image sticking of a display panel upon shutdown. As illustrated in FIG. 1, the driving method comprises the following operations:

S01: receiving a shutdown signal; and

S02: adjusting driving signals of a sub-pixel circuit of the display panel, so as to reduce the voltage difference between a gate electrode and a source electrode of a driving transistor of the sub-pixel circuit, and hence allowing the display panel to enter an image sticking prevention mode.

The sub-pixel circuit includes the driving transistor. In the black mode and the non-compensation mode, the voltage difference between both ends of a storage capacitor, connected between the gate electrode and another electrode (e.g., the source electrode) of the driving transistor, is reduced. For instance, charges at both ends of the storage capacitor are released, so as to reduce the voltage difference between both ends of the storage capacitor.

For instance, in the image sticking prevention mode, the gate electrode of the driving transistor receives corresponding voltage when the sub-pixel circuit displays a zero gray scale.

For instance, in the driving method for preventing image sticking of the display panel at the time of shutdown, the operation of allowing the display panel to enter the image sticking prevention mode includes a black image execution period and a data writing execution period.

Figure 3:
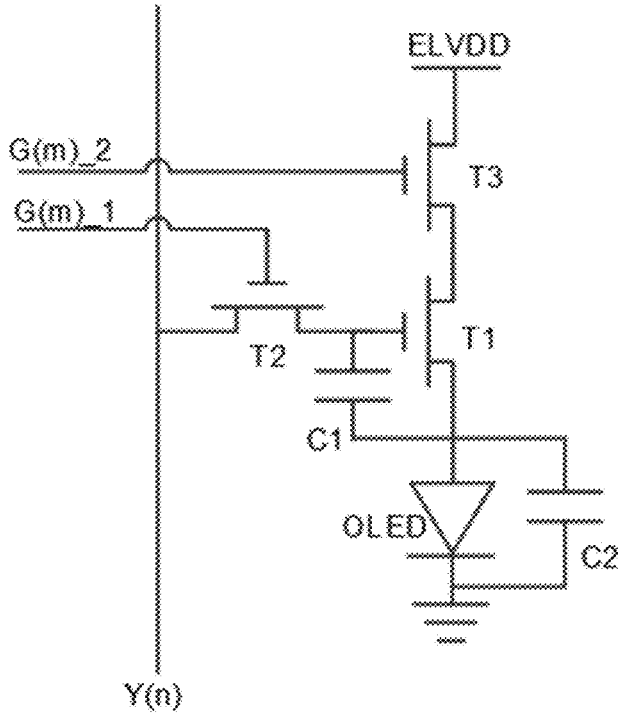
FIG. 3 is a schematic diagram 1 illustrating the drive structure of a sub-pixel circuit in an OLED display device provided by an embodiment of the present disclosure.

In some embodiments, the sub-pixel circuit includes a first gate line, a second gate line, a data line, a driving power line and an OLED apparatus (for instance, as shown in FIG. 3). The driving signals include a first scanning signal applied to the first gate line, a second scanning signal applied to the second gate line, a data signal applied to the data line, and a driving power signal applied to the driving power line. For instance, the voltage difference between both ends of the storage capacitor is reduced to be the difference between the corresponding voltage in the case of displaying the zero gray scale and the cut-in (turn-on) voltage of the OELD apparatus. For instance, the operation of setting the driving signals of the sub-pixel circuit of the display panel and hence allowing the display panel to enter the image sticking prevention mode includes: at the black image period, setting the first scanning signal to be the cut-off (turn-off) voltage, the second scanning signal to be a cut-in voltage, the driving power signal to be a cut-in voltage, and the data signal to be the corresponding voltage in the case of displaying the zero gray scale. For instance, the operation of setting the driving signals of the sub-pixel circuit of the display panel and hence allowing the display panel to enter the image sticking prevention mode includes: at the data writing period, setting the first scanning signal to be a cut-in voltage, the second scanning signal to be a cut-in voltage, the driving power signal to be a cut-in voltage, and the data signal to be the corresponding voltage in the case of displaying the zero gray scale.

Figure 5:
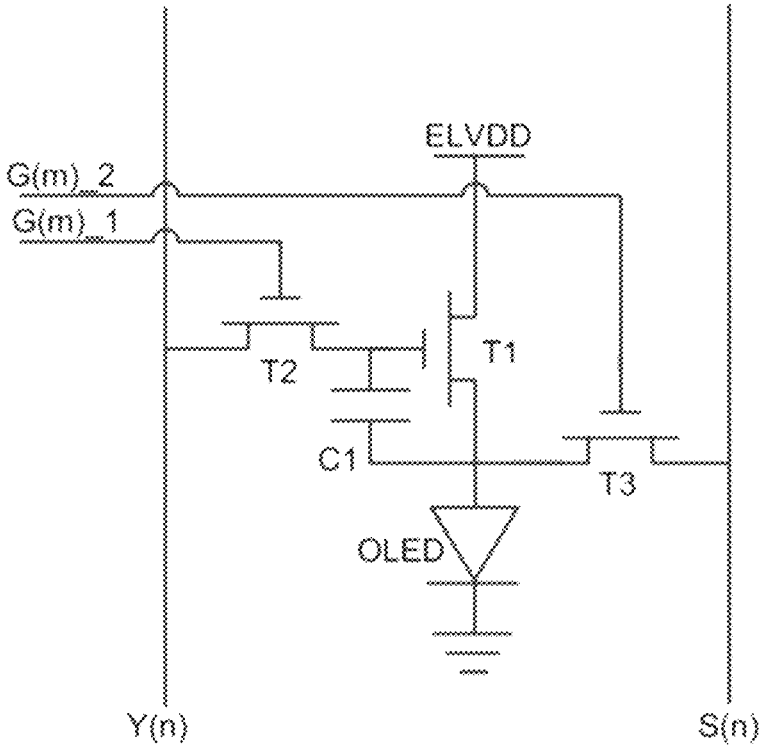
FIG. 5 is a schematic diagram 2 illustrating the drive structure of a sub-pixel circuit in the OLED display device provided by an embodiment of the present disclosure.

In other embodiments, the sub-pixel circuit includes a first gate line, a second gate line, a data line, a driving power line and a sensing line (e.g., as shown in FIG. 5). The driving signals include a first scanning signal applied to the first gate line, a second scanning signal applied to the second gate line, a data signal applied to the data line, a driving power signal applied to the driving power line, and a sensing signal applied to the sensing line.

For instance, the voltage difference between both ends of the storage capacitor is reduced to be the difference between the corresponding voltage in the case of displaying the zero gray scale and low sensing voltage. The operation of setting the driving signals of the sub-pixel circuit of the display panel and hence allowing the display panel to enter the image sticking prevention mode includes: at the black image period, setting the first scanning signal to be a cut-off voltage, the second scanning signal to be a cut-off voltage, the driving power signal to be a cut-off voltage, the data signal to be the corresponding voltage in the case of displaying the zero gray scale, and the sensing voltage signal to be the low sensing voltage. The operation of setting the driving signals of the sub-pixel circuit of the display panel and hence allowing the display panel to enter the image sticking prevention mode includes: at the data writing period, setting the first scanning signal to be a cut-in voltage, the second scanning signal to be a cut-in voltage, the driving power signal to be a cut-off voltage, the data signal to be the corresponding voltage in the case of displaying the zero gray scale, and the sensing voltage signal to be the low sensing voltage.

Moreover, for instance, the operation of setting the driving signals of the sub-pixel circuit of the display panel and hence allowing the display panel to enter the image sticking prevention mode includes: at the black image period, setting the first scanning signal to be a cut-off voltage, the second scanning signal to be a cut-off voltage, the driving power signal to be a cut-off voltage, the data signal to be the corresponding voltage in the case of displaying the zero gray scale, and the sensing voltage signal to be the low sensing voltage. The operation of setting the driving signals of the sub-pixel circuit of the display panel and hence allowing the display panel to enter the image sticking prevention mode includes: at the data writing period, setting the first scanning signal to be a cut-in voltage, the second scanning signal to be a cut-off voltage, the driving power signal to be a cut-off voltage, the data signal to be the corresponding voltage in the case of displaying the zero gray scale, and the sensing voltage signal to be the low sensing voltage.

Before the operation of receiving the shutdown signal, the driving method for preventing image sticking of the display panel at the time of shutdown, provided by the embodiment of the present disclosure, further comprises: receiving a startup signal; electrifying logic power; receiving image data in a display device; electrifying driving power; and displaying the image data in the display device.

After the operation of setting the driving signals of the sub-pixel circuit of the display panel and hence allowing the display panel to enter the image sticking prevention mode, the driving method for preventing image sticking of the display panel at the time of shutdown, provided by the embodiment of the present disclosure, further comprises: turning off the logic power and the driving power.

For instance, in the driving method for preventing image sticking of the display panel at the time of shutdown, provided by the embodiment of the present disclosure, the sub-pixel circuit includes a first gate line, a second gate line, a data line and a driving power line. The driving signals include a first scanning signal applied to the first gate line, a second scanning signal applied to the second gate line, a data signal applied to the data line, and a driving power signal applied to the driving power line. The operation of displaying the image data in the display device includes: at the normal emission period, setting the first scanning signal to be a cut-off voltage, the second scanning signal to be a cut-in voltage, and the driving power signal to be a cut-in voltage; at the resetting period, setting the first scanning signal to be a cut-in voltage, the second scanning signal to be a cut-in voltage, and the driving power signal to be a cut-off voltage; at the compensation period, setting the first scanning signal to be a cut-in voltage, the second scanning signal to be a cut-in voltage, and the driving power signal to be a cut-in voltage; and at the writing period, setting the first scanning signal to be a cut-in voltage, the second scanning signal to be a cut-off voltage, the driving power signal to be a cut-in voltage, and the data signal to be the voltage corresponding to a written data signal.

Figure 2:
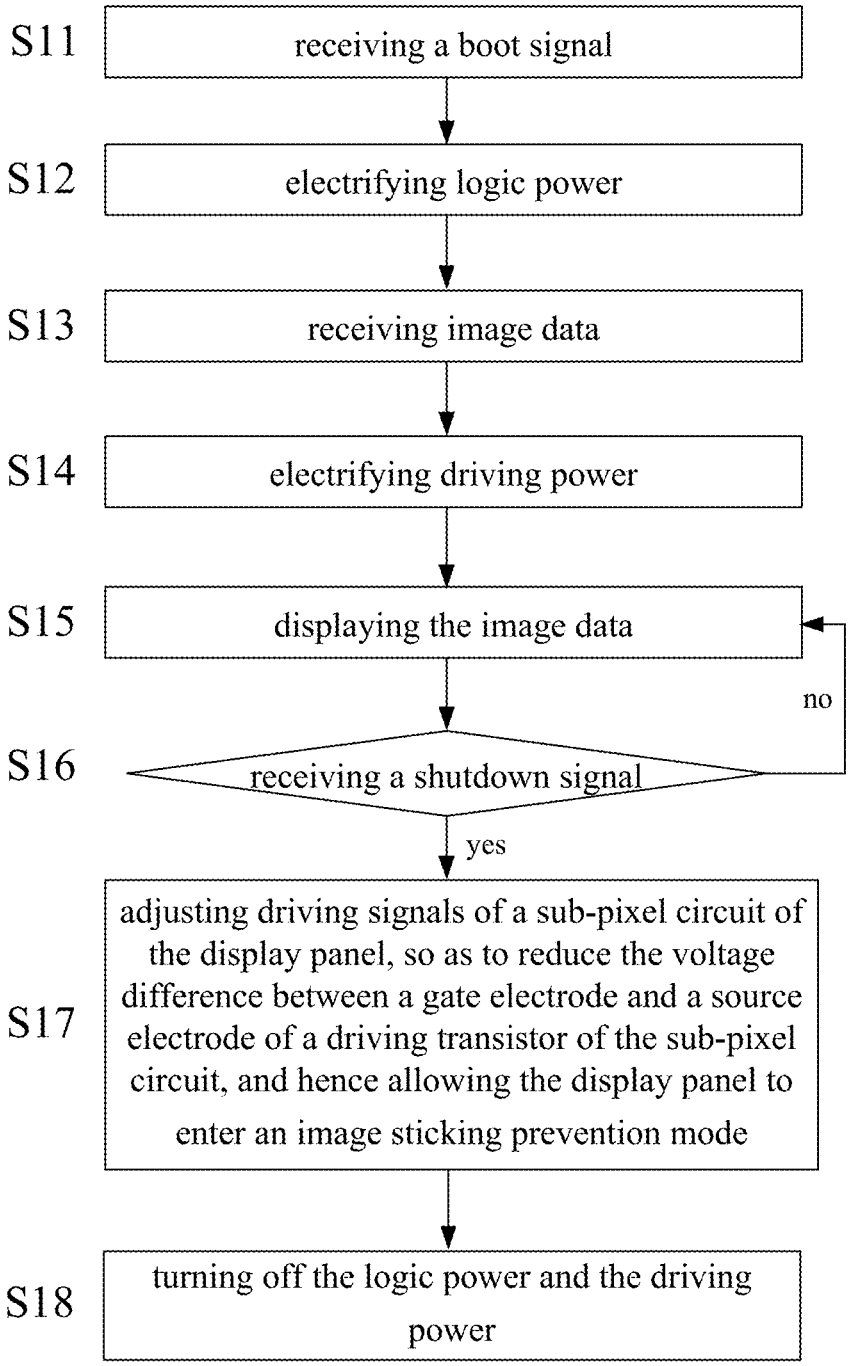
FIG. 2 is a flow diagram 2 of the driving method for preventing image sticking of the display panel at the time of shutdown, provided by an embodiment of the present disclosure.

An embodiment of the present disclosure provides a driving method for preventing image sticking of a display panel at the time of shutdown. As illustrated in FIG. 2, the driving method comprises the following operations:

S11: receiving a startup signal;

S12: electrifying logic power;

S13: receiving image data in a display device;

S14: electrifying driving power;

S15: displaying the image data in the display device;

S16: determining whether a shutdown signal has been received, returning to the step S15 to continuously display the image data if not receiving the shutdown signal, and executing the step S17 if receiving the shutdown signal;

S17: adjusting driving signals of a sub-pixel circuit of the display panel, so as to reduce the voltage difference between a gate electrode and a source electrode of a driving transistor of the sub-pixel circuit, and hence allowing the display panel to enter the image sticking prevention mode; and S18: turning off the logic power and the driving power.

For instance, step S16 as shown in FIG. 2 corresponds to step S01 as shown in FIG. 1, and step S17 as shown in FIG. 2 corresponds to step 02 as shown in FIG. 1.

Figures 4A, 4B:
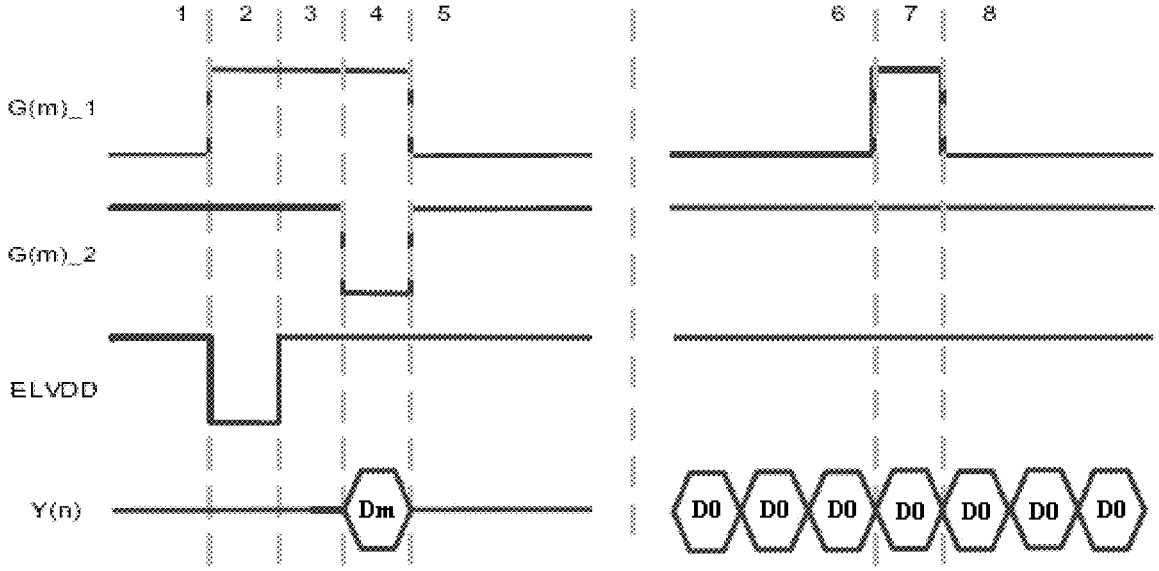
FIG. 4A is a driving timing diagram of the sub-pixel circuit as shown in FIG. 3 in the case of normal display.
FIG. 4B is a driving timing diagram of the sub-pixel circuit as shown in FIG. 3 in the image sticking prevention mode.

FIG. 3 is a schematic diagram illustrating the drive architecture of a sub-pixel circuit of an OLED display device provided by an embodiment of the present disclosure, and the sub-pixel circuit adopts internal pixel compensation mode. FIG. 4A is a driving timing diagram of the sub-pixel circuit as shown in FIG. 3 in the case of normal display, and FIG. 4B is a driving timing diagram of the sub-pixel circuit as shown in FIG. 3 in the image sticking prevention mode. Detailed description will be given below to the driving method as shown in FIG. 1 or 2, taking the internal pixel compensation mode as an example, with reference to the sub-pixel circuit as shown in FIG. 3 and the driving timing diagrams as shown in FIGS. 4A and 4B.

Description is given in FIG. 3 by taking sub-pixels in the $m^{th}$ row and the $n^{th}$ column as an example. Each sub-pixel circuit includes a driving transistor T1, a switching transistor T2, a third transistor T3, a storage capacitor C1, a second capacitor C2, a data line Y(n), a first gate line G(m)_1, a second gate line G(m)_2, a driving power line ELVDD and an OLED apparatus.

For instance, as shown in FIG. 3, a drain electrode of the third transistor T3 is electrically connected with the driving power line ELVDD; a gate electrode of the third transistor T3 is electrically connected with the second gate line G(m)_2; a source electrode of the third transistor T3 is electrically connected with a drain electrode of the driving transistor T1; a gate electrode of the driving transistor T1, a first end of the storage capacitor C1 and a source electrode of the switching transistor T2 are electrically connected with each other; a source electrode of the driving transistor T1, a second end of the storage capacitor C1, a first end of the OLED apparatus and a first end of the second capacitor C2 are electrically connected with each other; a drain electrode of the switching transistor T2 is electrically connected with the data line Y(n); a gate electrode of the switching transistor T2 is electrically connected with the first gate line G(m)_1; and a second end of the OLED apparatus and a second end of the second capacitor C2 are both grounded. Or the source electrode and the drain electrode of the driving transistor T1 are exchanged at position, namely the source electrode of the third transistor T3 is electrically connected with the source electrode of the driving transistor T1, and the drain electrode of the driving transistor T1, the second end of the storage capacitor C1, the first end of the OLED apparatus and the first end of the second capacitor C2 are electrically connected with each other.

For instance, as shown in FIG. 4A, at the moment 1 and the moment 5, the OLED apparatus of the sub-pixel circuit is at the normal emission period, and at the normal emission period, the method sets a first scanning signal applied to the first gate line G(m)_1 to be a cut-off voltage, a second scanning signal applied to the second gate line G(m)_2 to be a cut-in voltage, and a driving power signal applied to the driving power line ELVDD to be a cut-in voltage; the moment 2 is the resetting period, and at the resetting period, the method sets the first scanning signal applied to the first gate line G(m)_1 to be a cut-in voltage, the second scanning signal applied to the second gate line G(m)_2 to be a cut-in voltage, and the driving power signal applied to the driving power line ELVDD to be a cut-off voltage; the moment 3 is the compensation period, and at the compensation period, the method sets the first scanning signal applied to the first gate line G(m)_1 to be a cut-in voltage, the second scanning signal applied to the second gate line G(m)_2 to be a cut-in voltage, and the driving power signal applied to the driving power line ELVDD to be a cut-in voltage; and the moment 4 is the data writing period, and at the writing period, the method sets the first scanning signal applied to the first gate line G(m)_1 to be a cut-in voltage, the second scanning signal applied to the second gate line G(m)_2 to be a cut-off voltage, the driving power signal applied to the driving power line ELVDD to be a cut-in voltage, and a data signal applied to the data line Y(n) to be the voltage corresponding to a written data signal Dm.

For instance, the cut-in voltage is high level voltage and the cut-off voltage is low level voltage. The high level voltage is, for instance, 5V, and the low level voltage is, for instance, 0V. It should be noted that the embodiment of the present disclosure includes but not limited to this case. When the structure of the sub-pixel circuit and/or the type of the transistor changes, correspondingly, the cut-in voltage may also be low level voltage and the cut-off voltage may also be high level voltage.

For instance, at the moment of shutdown, the data signal applied to the data line Y(n) is set to be Dm=0V, and the driving power signal applied to the driving power line ELVDD is set to be a cut-off voltage. At this point, the display device displays a black image. However, if the display device is completely powered down when the $m+2^{th}$ row is scanned, the sub-pixel circuit in the $m^{th}$ row is just at the resetting period of the moment 2, the voltage at both ends of the storage capacitor C1 is not completely released. For example, the voltage difference between both ends of the storage capacitor C1 is, for instance, more than 5V. Thus, the voltage difference between both ends of the storage capacitor C1 at the moment of shutdown will result in the electric stress between the gate electrode and the source electrode of the driving transistor T1, and then result in the threshold drift of the driving transistor T1, so that the $m^{th}$ row will display dark lines in the normal display of the image next time, namely the image will have retained dark lines.

Moreover, for instance, if the display device is completely powered down when the $m+3^{th}$ row is scanned, the sub-pixel circuit in the $m+1^{th}$ row is just at the resetting period of the moment 2, and the voltage at both ends of the storage capacitor C1 is not completely released (for example, the voltage difference between both ends of the storage capacitor C1 is, for instance, more than 5V). Thus, the voltage difference between both ends of the storage capacitor C1 at the moment of shutdown will result in the electric stress between the gate electrode and the source electrode of the driving transistor T1, and then result in the threshold drift of the driving transistor T1, so that it will be clearly observed that the $m+1^{th}$ row displays dark lines in the normal display of the image next time, namely the image will have retained dark lines. By analogy, when any row is scanned, the sub-pixel circuit in another row will always be at the resetting period of the moment 2, and hence the image will have retained dark lines.

The driving method for preventing image sticking of the display panel at the time of shutdown, provided by an embodiment of the present disclosure, as shown in FIG. 1 or 2 can avoid or reduce the image sticking phenomenon caused at the moment of shutdown. Illustrative explanation will be given below to the image sticking prevention mode in the step S02 as shown in FIG. 1 and the step S17 as shown in FIG. 2, with reference to FIG. 4B.

For instance, the driving timing diagram of the sub-pixel circuit is as shown in FIG. 4B. At the moment 6 and the moment 8, the display panel is at the black image period. At the black image period, the method sets the first scanning signal applied to the first gate line G(m)_1 to be a cut-off voltage, the second scanning signal applied to the second gate line G(m)_2 to be a cut-in voltage, the driving power signal applied to the driving power line ELVDD to be a cut-in voltage, and the voltage of the data signal applied to the data line Y(n) to be D0. D0 is, for instance, the voltage applied to the data line when the display image displays the zero gray scale, namely the minimum voltage which can be outputted by the data line Y(n) in the case of normal display. At the moment 7, the display panel is at the data writing period. At the data writing period, the method sets the first scanning signal applied to the first gate line G(m)_1 to be a cut-in voltage, the second scanning signal applied to the second gate line G(m)_2 to be a cut-in voltage, the driving power signal applied to the driving power line ELVDD to be a cut-in voltage, and the voltage of the data signal applied to the data line Y(n) to be D0.

For instance, in the image sticking prevention mode, the driving power signal applied to the driving power line ELVDD may also be a cut-off voltage.

After the black mode and the non-compensation mode, the storage capacitor C1 is fully discharged, and the voltage difference between both ends of the storage capacitor C1 is D0-VOLED, in which VOLED refers to the cut-in voltage of the OLED apparatus, namely the voltage difference is reduced to be the difference between the corresponding voltage in the case of displaying the zero gray scale and the cut-in voltage of the OLED apparatus. The voltage difference D0-VOLED is very small, e.g., 0V to 1V. Thus, the voltage difference between both ends of the storage capacitor C1 after shutdown will not result in the threshold drift of the driving transistor T1, so as to reduce or avoid the image sticking phenomenon caused by the factor that the charges at both ends of the storage capacitor C1 are not completely released at the moment of shutdown.

For instance, in the image sticking prevention mode, the voltage of the data signal applied to the data line Y(n) is D0, and D0 is less than the voltage corresponding to the data signal Dm in the normal display of the display panel. Thus, the voltage difference between both ends of the storage capacitor C1 can be reduced, so as to reduce the image sticking phenomenon caused by the factor that the charges at both ends of the storage capacitor C1 are not completely released at the moment of shutdown.

For instance, the image sticking prevention mode lasts for the time of more than two frames. As for the sub-pixel circuits in other rows except the $m^{th}$ row, the driving method provided by the embodiment of the present disclosure may also reduce the voltage difference between both ends of the storage capacitor C1, so as to reduce the voltage difference between both ends of the storage capacitors C1 in all the sub-pixels of the entire display panel, and hence can reduce or avoid the image sticking phenomenon caused by the factor that the charges at both ends of the storage capacitor C1 are not completely released at the moment of shutdown.

Figure 6A:
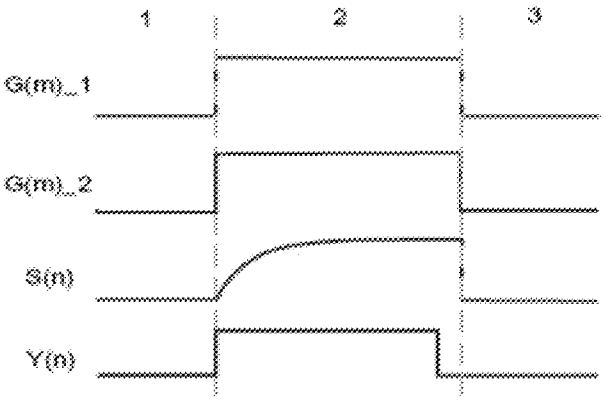
FIG. 6A is a driving timing diagram of the sub-pixel circuit as shown in FIG. 5 in the case of normal sensing.
Figure 6B:
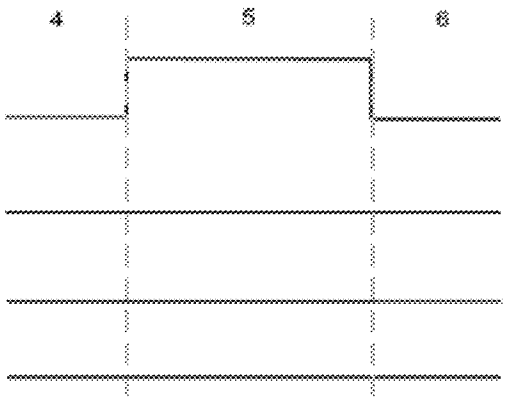
FIG. 6B is a driving timing diagram 1 of the sub-pixel circuit as shown in FIG. 5 in the image sticking prevention mode.
Figure 6C:
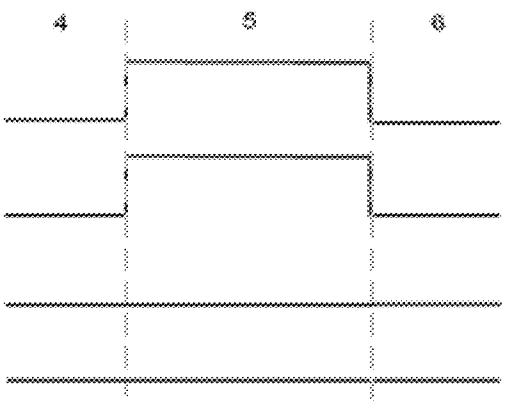
FIG. 6C is a driving timing diagram 2 of the sub-pixel circuit as shown in FIG. 5 in the image sticking prevention mode.

FIG. 5 is a schematic diagram illustrating the drive architecture of a sub-pixel circuit of an OLED display device, provided by the embodiment of the present disclosure, and the sub-pixel circuit adopts external pixel compensation mode. FIG. 6A is a driving timing diagram of the sub-pixel circuit as shown in FIG. 5 in the case of normal sensing; FIG. 6B is a driving timing diagram 1 of the sub-pixel circuit as shown in FIG. 5 in the image sticking prevention mode; and FIG. 6C is a driving timing diagram 2 of the sub-pixel circuit as shown in FIG. 5 in the image sticking prevention mode. Detailed description will be given below to the driving method as shown in FIG. 1 or 2, taking the external pixel compensation mode as an example, with reference to the sub-pixel circuit as shown in FIG. 5 and the driving timing diagrams as shown in FIGS. 6A to 6C.

For instance, description is given in FIG. 5 by taking sub-pixels in the $m^{th}$ row and the $n^{th}$ column as an example. Each sub-pixel circuit includes a driving transistor T1, a switching transistor T2, a third transistor T3, a storage capacitor C1, a data line Y(n), a first gate line G(m)_1, a second gate line G(m)_2, a driving power line ELVDD, a sensing line S(n) and an OLED apparatus.

As shown in FIG. 5, a drain electrode of the third transistor T3 is electrically connected with the driving sensing line S(n); a gate electrode of the third transistor T3 is electrically connected with the second gate line G(m)_2; a source electrode of the third transistor T3 is electrically connected with a source electrode of the driving transistor T1, a second end of the storage capacitor C1 and a first end of the OLED apparatus; a gate electrode of the driving transistor T1 is electrically connected with a first end of the storage capacitor C1 and a source electrode of the switching transistor T2; a drain electrode of the driving transistor T1 is electrically connected with the driving power line ELVDD; a drain electrode of the switching transistor T2 is electrically connected with the data line Y(n); a gate electrode of the switching transistor T2 is electrically connected with the first gate line G(m)_1; and a second end of the OLED apparatus is grounded.

For instance, as shown in FIG. 6A, at the moment 1 and the moment 3, the OLED apparatus of the sub-pixel is in normal display, and the method sets a first scanning signal applied to the first gate line G(m)_1 to be a cut-off voltage, a second scanning signal applied to the second gate line G(m)_2 to be a cut-off voltage, and a sensing signal applied to the sensing line S(n) to be a cut-off voltage. At the moment 2, the OLED apparatus is at the threshold sensing period of the driving transistor T1, and the method sets the first scanning signal applied to the first gate line G(m)_1 to be a cut-in voltage, the second scanning signal applied to the second gate line G(m)_2 to be a cut-in voltage, and the sensing signal applied to the sensing line S(n) to be the gradually increased voltage as shown in FIG. 6A. For instance, the maximum voltage of the sensing signal applied to the sensing line S(n) is lower than the minimum voltage required for the emission of the OLED apparatus. At this point, the OLED apparatus does not emit light, and the data signal applied to the data line Y(n) is the voltage corresponding to a written data signal. When the power is off, the voltage at both ends of the storage capacitor C1 is not completely released, and the voltage difference between both ends of the storage capacitor C1 is, for instance, more than 8V. Thus, the voltage difference between both ends of the storage capacitor C1 will result in the electric stress between the gate electrode and the source electrode of the driving transistor T1 at the moment of shutdown, and then result in the threshold drift of the driving transistor T1, so that the image will have retained dark lines.

The driving method for preventing image sticking of the display panel at the time of shutdown, provided by an embodiment of the present disclosure, as shown in FIG. 1 or 2 can avoid or reduce the image sticking phenomenon caused at the moment of shutdown. For instance, illustrative explanation will be given below to the image sticking prevention mode in the step S02 as shown in FIG. 1 and the step S17 as shown in FIG. 2, with reference to FIGS. 6B and 6C.

For instance, the driving timing diagram of the sub-pixel circuit is as shown in FIG. 6B. At the moment 4 and the moment 6, the display panel is at the black image period. At the black image period, the method sets the first scanning signal applied to the first gate line G(m)_1 to be a cut-off voltage, the second scanning signal applied to the second gate line G(m)_2 to be a cut-off voltage, the sensing signal applied to the sensing line S(n) to be low sensing voltage, and the voltage of the data signal applied to the data line Y(n) to be D0. D0 is, for instance, the voltage applied to the data line when the display image displays the zero gray scale, namely the minimum voltage which can be outputted by the data line Y(n) in the case of normal display. At the moment 5, the display panel is at the data writing period. At the data writing period, the method sets the first scanning signal applied to the first gate line G(m)_1 to be a cut-in voltage, the second scanning signal applied to the second gate line G(m)_2 to be a cut-off voltage, the sensing signal applied to the sensing line S(n) to be the low sensing voltage, and the voltage of the data signal applied to the data line Y(n) to be D0.

After the image sticking prevention mode, the storage capacitor C1 is fully discharged, and the voltage difference between both ends of the storage capacitor C1 is D0-Vpre, in which Vpre refers to the low sensing voltage, for instance, the low sensing voltage Vpre is 0V, namely the voltage difference is reduced to be the difference between the corresponding voltage in the case of displaying the zero gray scale and the low sensing voltage. The voltage difference D0-Vpre is very small, e.g., 0V to 1V. Thus, the voltage difference between both ends of the storage capacitor C1 after shutdown will not result in the threshold drift of the driving transistor T1, so as to reduce or avoid the image sticking phenomenon caused by the factor that the charges at both ends of the storage capacitor C1 are not completely released at the moment of shutdown.

Moreover, for instance, the driving timing diagram of the sub-pixel circuit is as shown in FIG. 6C. At the moment 4 and the moment 6, the display panel is at the black image period. At the black image period, the method sets the first scanning signal applied to the first gate line G(m)_1 to be a cut-off voltage, the second scanning signal applied to the second gate line G(m)_2 to be a cut-off voltage, the sensing signal applied to the sensing line S(n) to be low sensing voltage, and the voltage of the data signal applied to the data line Y(n) to be D0. D0 is, for instance, the voltage applied to the data line when the display image displays the zero gray scale, namely the minimum voltage which can be outputted by the data line Y(n) in the case of normal display. At the moment 5, the display panel is at the data writing period (at this point, the data writing period is also the sensing period). At the data writing period, the method sets the first scanning signal applied to the first gate line G(m)_1 to be a cut-in voltage, the second scanning signal applied to the second gate line G(m)_2 to be a cut-in voltage, the sensing signal applied to the sensing line S(n) to be the low sensing voltage, and the voltage of the data signal applied to the data line Y(n) to be D0.

After the image sticking prevention mode, the storage capacitor C1 is fully discharged, and the voltage difference between both ends of the storage capacitor C1 is D0-Vpre, in which Vpre refers to the low sensing voltage, namely the voltage difference is reduced to be the difference between the corresponding voltage in the case of displaying the zero gray scale and the low sensing voltage. The voltage difference D0-Vpre is very small, e.g., 0V to 1V. Thus, the voltage difference between both ends of the storage capacitor C1 after shutdown will not result in the threshold drift of the driving transistor T1, so as to reduce or avoid the image sticking phenomenon caused by the factor that the charges at both ends of the storage capacitor C1 are not completely released at the moment of shutdown.

For instance, the image sticking prevention mode lasts for the time of more than two frames. As for the sub-pixel circuits in other rows except the $m^{th}$ row, the driving method provided by the embodiment of the present disclosure may also reduce the voltage difference between both ends of the storage capacitor C1, so as to reduce the voltage difference between both ends of the storage capacitors C1 in all the sub-pixels of the entire display panel, and hence can reduce or avoid the image sticking phenomenon caused by the factor that the charges at both ends of the storage capacitor C1 are not completely released at the moment of shutdown.

It should be noted that the driving method for preventing image sticking of the display panel at the time of shutdown, provided by the embodiment of the present disclosure, is applicable to, including but not limited to, the structures of the sub-pixel circuits and the types of the transistors in the embodiment of the present disclosure.

It should be noted that the transistors in the embodiments of the present disclosure may be N-type enhancement transistors. If the sub-pixel circuits employ N-type depletion, P-type enhancement or P-type depletion transistors, the image sticking phenomenon of the display panel at the time of shutdown may also be prevented by corresponding transformation of the driving signals. No further description will be given here.

Figure 7:
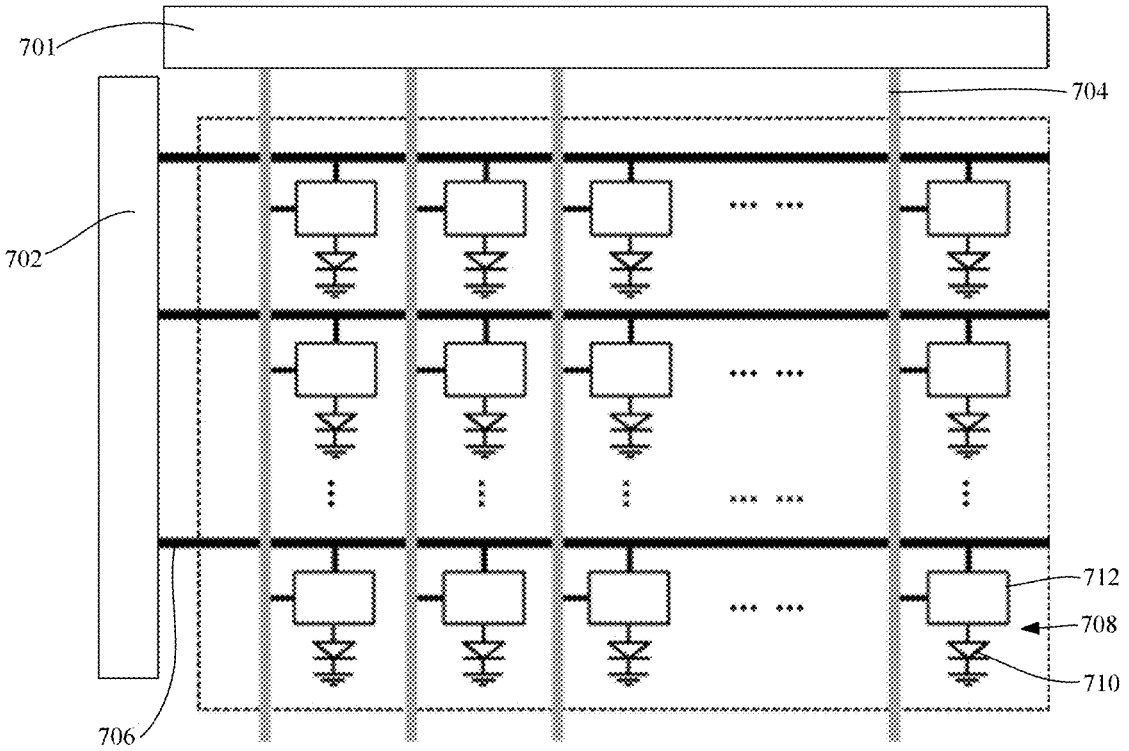
FIG. 7 is a schematic diagram 1 of an OLED display device provided by an embodiment of the present disclosure.

For instance, FIG. 7 is a schematic diagram of an OLED display device provided by an embodiment of the present disclosure. As illustrated in FIG. 7, the display device comprises a data conversion circuit 701, a scanning circuit 702, a plurality of data signal lines 704, a plurality of scanning signal lines 706 and a plurality of sub-pixel circuits 708, wherein each sub-pixel circuit 708 includes an OLED apparatus 710, two or more thin-film transistors (TFTs) (not shown in FIG. 7), and one or more capacitors (not shown in FIG. 7). The two or more TFTs and the one or more capacitors may be disposed in a box 712. The connection relationship between the two or more TFTs and the one or more capacitors may refer to the connection between the TFTs and the capacitors in the sub-pixel circuit as shown in FIG. 3 or 5. For instance, the two or more TFTs and the one or more capacitors may be the TFTs T1, T2 and T3 and the capacitors C1 and C2 as shown in FIG. 3. Or the two or more TFTs and the one or more capacitors may be the TFTs T1, T2 and T3 and the capacitor C1 as shown in FIG. 5. The data conversion circuit 701 is configured to transmit data voltage and reference voltage to the sub-pixel circuits 708 through the data signal lines 704. Each column of sub-pixel circuits 708 correspond to one or more data signal lines 704. The scanning circuit 702 is configured to transmit control signals of switching TFTs, control signals for compensation, and power signals for emission to the sub-pixel circuits 708 through the scanning signal lines 706. Each row of sub-pixel circuits correspond to one or more scanning signal lines 706. The OLED apparatus 710 emits light with different brightness according to the data voltage inputted by the data signal lines 704.

The driving method for preventing image sticking of the display panel at the time of shutdown, and the display device, provided by an embodiment of the present disclosure, can reset the voltage (or charges) stored in pixel circuits at the moment of shutdown, and then prevent image sticking of the display panel at the time of shutdown, and hence improve the display quality. The driving method may be commonly used in various types of display devices, for instance, an internal compensation display device and an external compensation display device in OLED display devices, so as to effectively reduce the image sticking phenomenon caused at the moment of shutdown. The driving method may be adopted to eliminate the image sticking phenomenon caused by the factor that the data voltage or the sensing voltage for internal compensation or external compensation is not completely released at the moment of shutdown, and hence can improve the quality of display images.

Figure 8:
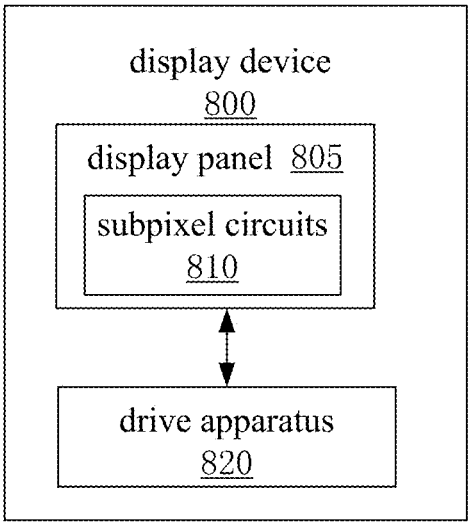
FIG. 8 is a schematic diagram 2 of the OLED display device provided by an embodiment of the present disclosure.

For instance, as illustrated in FIG. 8, the display device 800 provided by an embodiment of the present disclosure may comprise a drive apparatus 820 for preventing image sticking of a display panel at the time of shutdown, a display panel 805, and sub-pixel circuits 810 disposed on the display panel. For instance, the drive apparatus 820 may be a special hardware unit and is configured to realize the foregoing driving method for preventing image sticking of the display panel at the time of shutdown. For instance, the special hardware unit may be a programmable logic controller (PLC), a field programmable gate array (FPGA), an application specific integrated circuit (ASIC), a digital signal processor (DSP) or other programmable logic control devices. Moreover, for instance, the drive apparatus 820 may be a circuit board or a combination of a plurality of circuit boards and is configured to achieve the above functions. In the embodiment of the present disclosure, the one circuit or the combination of the plurality of circuit boards may include: (1) one or more processors; (2) one or more non-temporary computer-readable memories connected with the processors; and/or (3) firmware stored in the memories.

For instance, an embodiment of the present disclosure provides a display device, which comprises: a display panel; sub-pixel circuits being disposed on the display panel and including driving transistors and storage capacitors connected between gate electrodes and another electrodes of the driving transistors; and a drive apparatus configured to: adjust driving signals of the sub-pixel circuits of the display panel, so as to reduce the voltage difference between the gate electrodes and source electrodes of the driving transistors of the sub-pixel circuits, and hence allow the display panel to enter the image sticking prevention mode.

For instance, the operation of allowing the display panel to enter the image sticking prevention mode includes a black image execution period and a data writing execution period.

In one example, the sub-pixel circuit also includes a first gate line, a second gate line, a data line, a driving power line and an OLED apparatus; the driving signals include a first scanning signal applied to the first gate line, a second scanning signal applied to the second gate line, a data signal applied to the data line, and a driving power signal applied to the driving power line. The drive apparatus is configured to set the driving signals of the sub-pixel circuit of display panel and hence allow the display panel to enter the image sticking prevention mode, which includes: at the black image period, the drive apparatus is configured to set the first scanning signal to be a cut-off voltage, the second scanning signal to be a cut-in voltage, the driving power signal to be a cut-in voltage, and the data signal to be the corresponding voltage in the case of displaying the zero gray scale; and at the data writing period, the drive apparatus is configured to set the first scanning signal to be a cut-in voltage, the second scanning signal to be a cut-in voltage, the driving power signal to be a cut-in voltage, and the data signal to be the corresponding voltage in the case of displaying the zero gray scale.

In one example, the sub-pixel circuit includes a first gate line, a second gate line, a data line, a driving power line and a sensing line; and the driving signals include a first scanning signal applied to the first gate line, a second scanning signal applied to the second gate line, a data signal applied to the data line, a driving power signal applied to the driving power line, and a sensing signal applied to the sensing line. The drive apparatus is configured to set the driving signals of the sub-pixel circuits of the display panel and hence allow the display panel to enter the image sticking prevention mode, which includes: at the black image period, the drive apparatus is configured to set the first scanning signal to be a cut-off voltage, the second scanning signal to be a cut-off voltage, the driving power signal to be a cut-off voltage, the data signal to be the corresponding voltage in the case of displaying the zero gray scale, and the sensing voltage signal to be low sensing voltage; and at the data writing period, the drive apparatus is configured to set the first scanning signal to be a cut-in voltage, the second scanning signal to be a cut-in voltage, the driving power signal to be a cut-off voltage, the data signal to be the corresponding voltage in the case of displaying the zero gray scale, and the sensing voltage signal to be the low sensing voltage.

In one example, the sub-pixel circuit includes a first gate line, a second gate line, a data line, a driving power line and a sensing line; and the driving signals include a first scanning signal applied to the first gate line, a second scanning signal applied to the second gate line, a data signal applied to the data line, a driving power signal applied to the driving power line, and a sensing signal applied to the sensing line. The drive apparatus is configured to set the driving signals of the sub-pixel circuits of the display panel and hence allow the display panel to enter the image sticking prevention mode, which includes: at the black image period, the drive apparatus is configured to set the first scanning signal to be a cut-off voltage, the second scanning signal to be a cut-off voltage, the driving power signal to be a cut-off voltage, the data signal to be the corresponding voltage in the case of displaying the zero gray scale, and the sensing voltage signal to be low sensing voltage; and at the data writing period, the drive apparatus is configured to set the first scanning signal to be a cut-in voltage, the second scanning signal to be a cut-off voltage, the driving power signal to be a cut-off voltage, the data signal to be the corresponding voltage in the case of displaying the zero gray scale, and the sensing voltage signal to be the low sensing voltage.

For instance, before receiving a shutdown signal, the drive apparatus is configured to: receive a startup signal; electrify logic power; receive image data in a display device; electrify driving power; and display the image data in the display device.

For instance, after the drive apparatus sets the driving signals of the sub-pixel circuits of the display panel and hence allows the display panel to enter the image sticking prevention mode, the drive apparatus is configured to turn off the logic power and the driving power.

For instance, the sub-pixel circuit includes a first gate line, a second gate line, a data line and a driving power line; and the driving signals include a first scanning signal applied to the first gate line, a second scanning signal applied to the second gate line, a data signal applied to the data line, and a driving power signal applied to the driving power line. When displaying the image data in the display device, at the normal emission period, the drive apparatus is configured to set the first scanning signal to be a cut-off voltage, the second scanning signal to be a cut-in voltage, and the driving power signal to be a cut-in voltage; at the resetting period, the drive apparatus is configured to set the first scanning signal to be a cut-in voltage, the second scanning signal to be a cut-in voltage, and the driving power signal to be a cut-off voltage; at the compensation period, the drive apparatus is configured to set the first scanning signal to be a cut-in voltage, the second scanning signal to be a cut-in voltage, and the driving power signal to be a cut-in voltage; and at the writing period, the drive apparatus is configured to set the first scanning signal to be a cut-in voltage, the second scanning signal to be a cut-off voltage, the driving power signal to be a cut-in voltage, and the data signal to be the voltage corresponding to a written data signal.

Although detailed description has been given above to the present disclosure with reference to general description and preferred embodiments, it is apparent to those skilled in the art that some modifications or improvements may be made to the present disclosure on the basis of the embodiments of the present disclosure. Therefore, all the modifications or improvements made without departing from the spirit of the present disclosure shall fall within the scope of protection of the present disclosure.

The present application claims the priority of the Chinese Patent Application No. 201610236636.5 filed on Apr. 15, 2016, which is incorporated herein in its entirety by reference as part of the disclosure of the present application.

What is claimed is:

1. A driving method for preventing image sticking of a display panel upon shutdown, comprising:

receiving a shutdown signal; and adjusting driving signals of a sub-pixel circuit of the display panel, so as to reduce a voltage difference between a gate electrode and a source electrode of a driving transistor of the sub-pixel circuit, and hence allowing the display panel to enter an image sticking prevention mode;

wherein the sub-pixel circuit comprises a first gate line, a second gate line, a driving power line and a sensing line;

the driving signals comprise a first scanning signal applied to the first gate line, a second scanning signal applied to the second gate line, a driving power signal applied to the driving power line, and a sensing signal applied to the sensing line;

allowing the display panel to enter the image sticking prevention mode comprises executing a black image period;

at the black image period, setting the first scanning signal to be a cut-off voltage, the second scanning signal to be the cut-off voltage, the driving power signal to be the cut-off voltage, a data signal to be a corresponding voltage in a case of displaying a zero gray scale, and the sensing voltage signal to be a low sensing voltage;

the cut-off voltage is a turn-off voltage having a level allowing the driving transistor to be turned off, the corresponding voltage is a voltage for controlling the driving transistor to display the zero gray scale, and the low sensing voltage is a turn-off voltage having a level allowing the driving transistor to be turned off; and at the black image period, setting the first scanning signal to be only the cut-off voltage, the second scanning signal to be only the cut-off voltage, and the driving power signal to be only the cut-off voltage.

2. The driving method according to claim 1, wherein in the image sticking prevention mode, the gate electrode of the driving transistor receives the corresponding voltage when the sub-pixel circuit displays the zero gray scale.

3. The driving method according to claim 1, wherein the voltage difference is reduced to be a difference between the corresponding voltage in the case of displaying the zero gray scale and the low sensing voltage.

4. The driving method according to claim 3, wherein the sub-pixel circuit comprises a data line;

the driving signals comprise the data signal applied to the data line; and in the image sticking prevention mode, the gate electrode of the driving transistor receives a voltage corresponding to the data signal applied to the data line when the sub-pixel circuit displays the zero gray scale.

5. The driving method according to claim 1, wherein allowing the display panel to enter the image sticking prevention mode further comprises executing a data writing period;

at the data writing period, setting the first scanning signal to be a cut-in voltage, the second scanning signal to be the cut-in voltage, the driving power signal to be the cut-off voltage, the data signal to be the corresponding voltage in the case of displaying the zero gray scale, and the sensing voltage signal to be the low sensing voltage; and the cut-in voltage is a turn-on voltage having a level allowing the driving transistor to be turned on.

6. The driving method according to claim 1, wherein allowing the display panel to enter the image sticking prevention mode further comprises executing a data writing period;

at the data writing period, setting the first scanning signal to be a cut-in voltage, the second scanning signal to be the cut-off voltage, the driving power signal to be the cut-off voltage, the data signal to be the corresponding voltage in the case of displaying the zero gray scale, and the sensing voltage signal to be the low sensing voltage; and the cut-in voltage is a turn-on voltage having a level allowing the driving transistor to be turned on.

7. The driving method according to claim 1, before receiving the shutdown signal, further comprising:

receiving a startup signal;

electrifying logic power;

receiving image data in the display panel;

electrifying driving power; and displaying the image data in the display device.

8. A display device, comprising:

a display panel;

a sub-pixel circuit being disposed on the display panel and including a driving transistor and a storage capacitor connected between a gate electrode and a source electrode of the driving transistor; and a drive apparatus configured to:

adjust driving signals of the sub-pixel circuit of the display panel, so as to reduce a voltage difference between the gate electrode and the source electrode of the driving transistor of the sub-pixel circuit, and hence allow the display panel to enter an image sticking prevention mode;

wherein allowing the display panel to enter the image sticking prevention mode comprises executing a black image period and executing a data writing period;

the sub-pixel circuit comprises a first gate line, a second gate line, a data line, a driving power line and a sensing line;

the driving signals comprise a first scanning signal applied to the first gate line, a second scanning signal applied to the second gate line, a data signal applied to the data line, a driving power signal applied to the driving power line, and a sensing signal applied to the sensing line; and the drive apparatus is configured to adjust the driving signals of the sub-pixel circuit of the display panel, so as to reduce the voltage difference between the gate electrode and the source electrode of the driving transistor of the sub-pixel circuit, and hence allow the display panel to enter the image sticking prevention mode, which comprises:

at the black image period, the drive apparatus is configured to set the first scanning signal to be a cut-off voltage, the second scanning signal to be the cut-off voltage, the driving power signal to be the cut-off voltage, the data signal to be a corresponding voltage in a case of displaying a zero gray scale, and the sensing voltage signal to be a low sensing voltage; and at the data writing period, the drive apparatus is configured to set the first scanning signal to be a cut-in voltage, the second scanning signal to be the cut-in voltage, the driving power signal to be the cut-off voltage, the data signal to be the corresponding voltage in the case of displaying the zero gray scale, and the sensing voltage signal to be the low sensing voltage;

the cut-in voltage is a turn-on voltage having a level allowing the driving transistor to be turned on, the cut-off voltage is a turn-off voltage having a level allowing the driving transistor to be turned off, the corresponding voltage is a voltage for controlling the driving transistor to display the zero gray scale, and the low sensing voltage is a turn-off voltage having a level allowing the driving transistor to be turned off; and at the black image period, the drive apparatus is configured to set the first scanning signal to be only the cut-off voltage, the second scanning signal to be only the cut-off voltage, and the driving power signal to be only the cut-off voltage.

9. A display device, comprising:

a display panel;

a sub-pixel circuit being disposed on the display panel and including a driving transistor and a storage capacitor connected between a gate electrode and a source electrode of the driving transistor; and a drive apparatus configured to:

adjust driving signals of the sub-pixel circuit of the display panel, so as to reduce a voltage difference between the gate electrode and the source electrode of the driving transistor of the sub-pixel circuit, and hence allow the display panel to enter an image sticking prevention mode;

wherein allowing the display panel to enter the image sticking prevention mode comprises executing a black image period and executing a data writing period;

the sub-pixel circuit comprises a first gate line, a second gate line, a data line, a driving power line and a sensing line;

the driving signals comprise a first scanning signal applied to the first gate line, a second scanning signal applied to the second gate line, a data signal applied to the data line, a driving power signal applied to the driving power line, and a sensing signal applied to the sensing line; and the drive apparatus is configured to adjust the driving signals of the sub-pixel circuit of the display panel, so as to reduce the voltage difference between the gate electrode and the source electrode of the driving transistor of the sub-pixel circuit, and hence allow the display panel to enter the image sticking prevention mode, which comprises:

at the black image period, the drive apparatus is configured to set the first scanning signal to be a cut-off voltage, the second scanning signal to be the cut-off voltage, the driving power signal to be the cut-off voltage, the data signal to be a corresponding voltage in a case of displaying a zero gray scale, and the sensing voltage signal to be a low sensing voltage; and at the data writing period, the drive apparatus is configured to set the first scanning signal to be a cut-in voltage, the second scanning signal to be the cut-off voltage, the driving power signal to be the cut-off voltage, the data signal to be the corresponding voltage in the case of displaying the zero gray scale, and the sensing voltage signal to be the low sensing voltage;

the cut-in voltage is a turn-on voltage having a level allowing the driving transistor to be turned on, the cut-off voltage is a turn-off voltage having a level allowing the driving transistor to be turned off, the corresponding voltage is a voltage for controlling the driving transistor to display the zero gray scale, and the low sensing voltage is a turn-off voltage having a level allowing the driving transistor to be turned off; and at the black image period, the drive apparatus is configured to set the first scanning signal to be only the cut-off voltage, the second scanning signal to be only the cut-off voltage, and the driving power signal to be only the cut-off voltage.

* * * * *